US007081909B2

(12) United States Patent
Shiraiwa

(10) Patent No.: US 7,081,909 B2
(45) Date of Patent: Jul. 25, 2006

(54) PRINTING CONTROL APPARATUS AND METHOD, AND HEAT TRANSFER PRINTING MEDIUM

(75) Inventor: Yoshinobu Shiraiwa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 997 days.

(21) Appl. No.: 10/040,402

(22) Filed: Jan. 9, 2002

(65) Prior Publication Data

US 2002/0093668 A1 Jul. 18, 2002

(30) Foreign Application Priority Data

Jan. 18, 2001 (JP) ..... 2001-010172
Dec. 25, 2001 (JP) ..... 2001-392734

(51) Int. Cl.
*B41J 21/00* (2006.01)
*B41J 21/16* (2006.01)

(52) U.S. Cl. ..... 347/171

(58) Field of Classification Search ..... 347/171
See application file for complete search history.

(56) References Cited

FOREIGN PATENT DOCUMENTS

| | | | |
|---|---|---|---|
| JP | 4-122953 A | | 4/1992 |
| JP | 6-270496 A | | 9/1994 |
| JP | 11-198551 | * | 7/1999 |
| JP | 11-198594 | * | 7/1999 |
| JP | 2000-218887 A | | 8/2000 |
| KR | 1999-0070621 A | | 9/1999 |
| KR | 2000-0032743 A | | 6/2000 |

OTHER PUBLICATIONS

Translation of JP 2000-218887.*

* cited by examiner

*Primary Examiner*—Huan Tran
(74) *Attorney, Agent, or Firm*—Fitzpatrick, Cella, Harper & Scinto

(57) ABSTRACT

To perform printing control to obtain printed products having different sizes in accordance with printing regions divided in the widthwise direction of a printing medium having a fixed width, a printing control method of performing heat transfer printing on a printing medium by using a heat transfer sheet checks whether to perform printing on the printing medium having a fixed width by dividing the printing region in the widthwise direction of the printing medium (S602). If printing is to be performed by dividing the printing region in the widthwise direction of the printing medium (YES in S602), the method controls printing for consecutive pages by making printing information of the consecutive pages to correspond to the printing regions divided in the widthwise direction of the printing medium.

9 Claims, 13 Drawing Sheets

PRINTING CONTROL APPARATUS AND METHOD, AND HEAT TRANSFER PRINTING MEDIUM

FIELD OF THE INVENTION

The present invention relates to a printing control apparatus and printing control method of printing an image having a plurality of colors by moving a printing sheet back and forth, and a heat transfer printing medium for use in this printing control apparatus and, more particularly, to a small-sized, inexpensive heat transfer type printing control apparatus which provides, by printing control, printed products of a plurality of different sizes or a printed product having an image printed on the entire surface of a printing sheet, a printing control method of the apparatus, and a heat transfer printing medium for use in the printing.

BACKGROUND OF THE INVENTION

With the recent spread of digital video cameras and digital cameras, the demand for color printers for printing color images obtained by these cameras is increasing. Although various systems are known as printing systems of such printers, an inkjet system is particularly attracting attention recently because, e.g., non-contact printing can be performed for a printing medium such as a paper sheet, color images are readily obtainable, and the noise is low. As the construction of this inkjet printer, a serial printing apparatus is generally widely used because the apparatus is inexpensive and can be made compact. This serial printing apparatus includes a printhead which discharges ink in accordance with desired printing information, and prints an image while scanning back and forth in a direction perpendicular to the feeding direction of a printing medium such as a paper sheet.

One color printer printing method is a method by which an ink sheet coated with heat-sublimating or hot-melt ink is selectively heated by a thermal head to transfer the ink image onto a printing sheet. In particular, a sublimation type heat transfer printing apparatus is expected as a color printer for a digital camera, since high-quality, full-color images can be obtained.

Generally, a heat transfer printing apparatus prints an image of a plurality of colors by moving a printing sheet back and forth. Therefore, it is necessary to held printing sheets during printing. Since this forms partial blank portions in which no images can be printed, an image cannot be printed on the entire surface of a printing sheet, unlike silver halide photographs. Some large-sized apparatuses for business use realize full-surface printing on an output printing sheet by using rolled printing paper and a built-in cutter.

Unfortunately, these apparatuses using rolled paper and having a built-in cutter are large and expensive. Therefore, the following method is known as a method by which a printed product having an image printed on the entire surface of a printing sheet is easily obtained by the use of a small-sized, inexpensive apparatus. This method uses printing paper having perforations for allowing easy cutting formed on the two sides in the conveyance direction of the sheet. Also, an image which is a size lager than a final printing sheet size cut from the perforations is printed. After the image is printed, the printing sheet is cut from the perforations to obtain a printed product (with no blanks) having an image printed on the entire surface of the printing sheet like a silver halide photograph. FIG. 2 shows an example of a printing sheet used in this method.

This printing sheet has a predetermined size. In addition, heat transfer printing generally prints a full-color image by printing images of a plurality colors by moving a printing sheet back and forth. So, an ink sheet for use in printing also has a predetermined size corresponding to the size of the sheet and is coated with inks of different colors for each predetermined width. FIG. 13 shows an example of an ink sheet. Referring to FIG. 13, on a band-like base 130, yellow ink layers Y, magenta ink layers M, and cyan ink layers C are repetitively arranged in repetitive units U in the longitudinal direction of the base 130. These inks layers of three colors can be arranged in an arbitrary order. Also, these color ink layers can be formed close to each other or with appropriate intervals between them. Alternatively, the ink layers can slightly overlap each other as long as no practical problem arises. Furthermore, black ink layers can be added to the repetitive units U.

As described above, the size of an ink sheet is determined in accordance with the size of a printing sheet. To obtain a printed product of a different size, therefore, it is necessary to prepare a printing sheet and ink sheet corresponding to that size. Accordingly, to obtain printed products of a plurality of different sizes, it is necessary to prepare printing sheets and ink sheets corresponding to these sizes.

Also, the above-mentioned apparatus for business use which has rolled printing paper and a built-in cutter can cut the printing sheet in a given length in the paper feeding direction. Hence, printed products of different sizes having almost arbitrary lengths in the paper feeding direction can be obtained.

As shown in FIG. 13 described above, however, an ink sheet is generally formed by repetitively arranging color ink layers in repetitive units U on a sheet having a predetermined size. If printing sizes are different, therefore, it is necessary to prepare ink sheets coated with color ink layers in accordance with these printing sizes. On the other hand, printed products differing in size can be obtained by the same ink sheet in some cases. In these cases, the size of a printed product is always equal to or smaller than the ink sheet size, so unused ink is wasted. For example, when a printed product having a size half that of an ink sheet is formed, the half of ink is wasted. When a printed product having a size ¾ the size of an ink sheet is formed, the ¼ of ink is wasted.

As described above, when printed products differing in size are formed using ink sheets of the same size without using ink sheets of different sizes, ink not used in printing is wasted.

SUMMARY OF THE INVENTION

The present invention has been made in consideration of the above situation, and has as its object to allow easy printing of printed products having a plurality of different sizes or a printed product having an image printed on the entire surface of a printing sheet, by using a small-sized, inexpensive printing apparatus, without preparing any printing sheets and ink sheets having a plurality of different sizes, i.e., by using printing sheets and ink sheets having the same size, and without wasting inks applied on the ink sheets.

To achieve the above object, a printing control apparatus and method, a computer-readable storage medium storing a program for executing the method by a computer, and a heat transfer printing medium according to the present invention are characterized by the following arrangements.

That is, a printing control apparatus for performing heat transfer printing on a printing medium by using a heat transfer sheet comprises, a printing control apparatus for performing heat transfer printing on a printing medium by using a heat transfer sheet, comprising: determining means for determining whether to perform printing by dividing a printing region in the widthwise direction of a printing medium having a fixed width; and printing control means for, when printing is to be performed by dividing the printing region in the widthwise direction of the printing medium in accordance with the determination by the determining means, controlling printing for consecutive pages by making printing information of the consecutive pages to correspond to the printing regions divided in the widthwise direction of the printing medium.

Preferably, in the above printing control apparatus, the printing control means counts the number of pages to be printed in accordance with the printing information and, if the counted number of pages is an odd number, notifies a user that one unit page becomes blank.

Preferably, in the above printing control apparatus, the apparatus further comprises identifying means for identifying the type of printing sheet, wherein the printing control means controls printing in accordance with the identification by the identifying means.

Preferably, in the above printing control apparatus, the printing region in the widthwise direction of the printing medium is divided into not less than two printing regions.

Also, a printing control method of performing heat transfer printing on a printing medium comprises a printing control method of performing heat transfer printing on a printing medium by using a heat transfer sheet, comprising: the determination step of determining whether to perform printing by dividing a printing region in the widthwise direction of a printing medium having a fixed width; and the printing control step of, when printing is to be performed by dividing the printing region in the widthwise direction of the printing medium in accordance with the determination in the determination step, controlling printing for consecutive pages by making printing information of the consecutive pages to correspond to the printing regions divided in the widthwise direction of the printing medium.

Preferably, in the above printing control method, the printing control step comprises counting the number of pages to be printed in accordance with the printing information and, if the counted number of pages is an odd number, notifying a user that one unit page becomes blank.

Preferably, in the above printing control method, the method further comprises the identification step of identifying the type of printing sheet, wherein in the printing control step, printing is controlled in accordance with the identification in the identification step.

Preferably, in the above printing control method, the printing region in the widthwise direction of the printing medium is divided into not less than two printing regions.

A storage medium storing a program module for executing, by a computer, a printing control program for performing heat transfer printing on a printing medium, in which the module comprises a storage medium storing a program module for allowing a computer to execute a printing control program for performing heat transfer printing on a printing medium, the module comprising: a determination module for determining whether to perform printing by dividing a printing region in the widthwise direction of a printing medium having a fixed width; and a printing control module for, when printing is to be performed by dividing the printing region in the widthwise direction of the printing medium in accordance with the determination by the determination module, controlling printing for consecutive pages by making printing information of the consecutive pages to correspond to the printing regions divided in the widthwise direction of the printing medium.

A heat transfer printing medium for use in a heat transfer type printing control apparatus comprises a heat transfer printing medium used in a heat transfer type printing control apparatus, comprising perforations in a position at which the dimension in the widthwise direction of the printing medium having a fixed width is equally divided, wherein printing regions of the printing medium divided by the perforations are used as a unit page size, and the perforations are used to separate a printing region of the unit page size.

Preferably, in the above heat transfer printing medium, the position at which the dimension in the widthwise direction of the printing medium having a fixed width is the center in the widthwise direction.

Preferably, in the above heat transfer printing medium, the heat transfer printing medium comprises four perforation lines in symmetrical positions with respect to the center in the widthwise direction of the medium.

Preferably, in the above heat transfer printing medium, a blank portion in which no images can be printed in order to clamp and convey the heat transfer printing medium during printing is removed by being separated from the perforations.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

First Embodiment

The first embodiment according to the present invention will be described in detail below with reference to the accompanying drawings.

Figure 1:
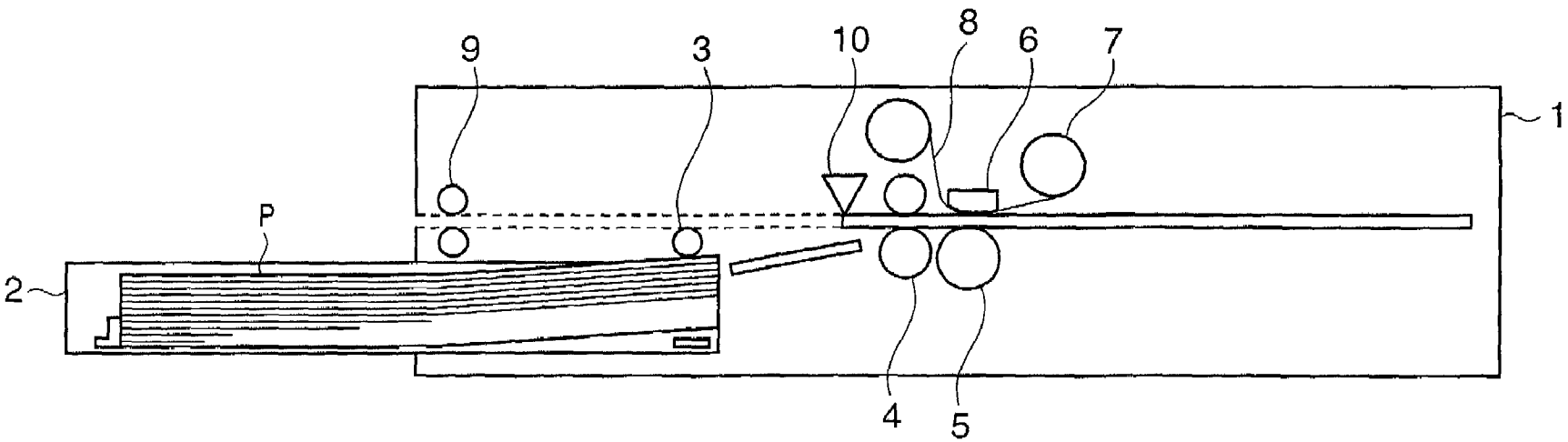
FIG. 1 is a side view showing an outline of a heat transfer printing apparatus according to an embodiment.

FIG. 1 is a schematic view showing the arrangement of the side surface of a heat transfer printing apparatus. The overall arrangement of this printing apparatus will be explained. Printing sheets P are separately fed one by one from a paper feed cassette 2 to an apparatus body 1 by a paper feed roller 3. Each printing sheet P is clamped and conveyed by a pair of conveyor rollers 4, and thereby moves back and forth in a printing section.

In this printing section, a platen roller 5 and a thermal head 6 which generates heat in accordance with printing information oppose each other on the two sides of a printing sheet conveyor path, and an ink sheet 8 is contained in an ink cassette 7. This ink sheet 8 has ink layers coated with hot-melt or heat-sublimating inks and an overcoat layer for overcoating a printing surface to protect this printing surface. The thermal head 6 pushes the ink sheet 8 against the printing sheet P and selectively heats the ink sheet 8. Consequently, a predetermined image is transferred onto the printing sheet P and overcoated with the protective layer.

The ink sheet 8 has ink layers of yellow (Y), magenta (M), and cyan (C) and an overcoat layer (OP) which cover the printing region of the printing sheet P (it also refers to as a heat transfer printing medium hereinafter) and which have a size substantially equal to the size of the printing region. Whenever each color ink layer is thermally transferred, the printing sheet P is returned to a printing start position P1, thereby sequentially printing the color ink layers to be overlapped on the printing sheet.

In this manner, the printing sheet P is moved back and forth by the pair of conveyor rollers 4 in accordance with the number of color ink layers and overcoat layers. Finally, the printing sheet P is guided to a pair of paper discharge rollers 9 and discharged outside the apparatus, and the printing operation is completed.

As described above, a common heat transfer printing apparatus prints three colors, yellow (Y), magenta (M), and cyan (C) for each ink sheet surface. Therefore, the end portion of each ink sheet surface must be accurately aligned with the leading edge of a printing sheet. For this purpose, the printing sheet P must be conveyed as it is strongly clamped between the pair of conveyor rollers 4 shown in FIG. 1. Accordingly, blank portions in which no images can be printed must be formed in the end portions of the printing sheet P.

Figure 2:
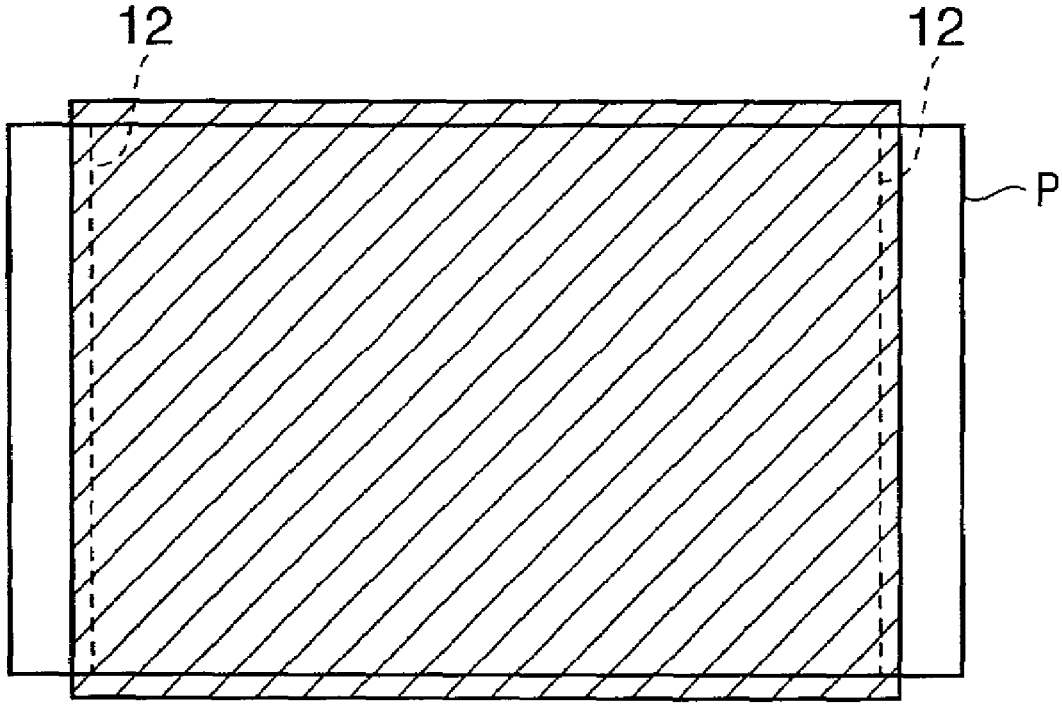
FIG. 2 is a view showing a conventional perforated printing sheet.

To finally obtain a printed product having no blank portions, as shown in FIG. 2, the printing sheet P has perforations 12 by which a blank portion which is strongly clamped between the pair of conveyor rollers 4 at the start of printing and a blank portion in which no images can be printed are easily cut with hands. Similar perforations 12 are also formed in a symmetrical position at the other end. This is so because the user can set these recording sheets in the sheet cassette 2 shown in FIG. 1 without paying attention to the direction of the sheets.

The present invention is practiced by using an ink sheet having a size corresponding to the printing sheet p having the perforations explained above, thereby obtaining printed products having a plurality of sizes different from a printed product shown in FIG. 2, without wasting the ink of the ink sheet.

Figure 3:
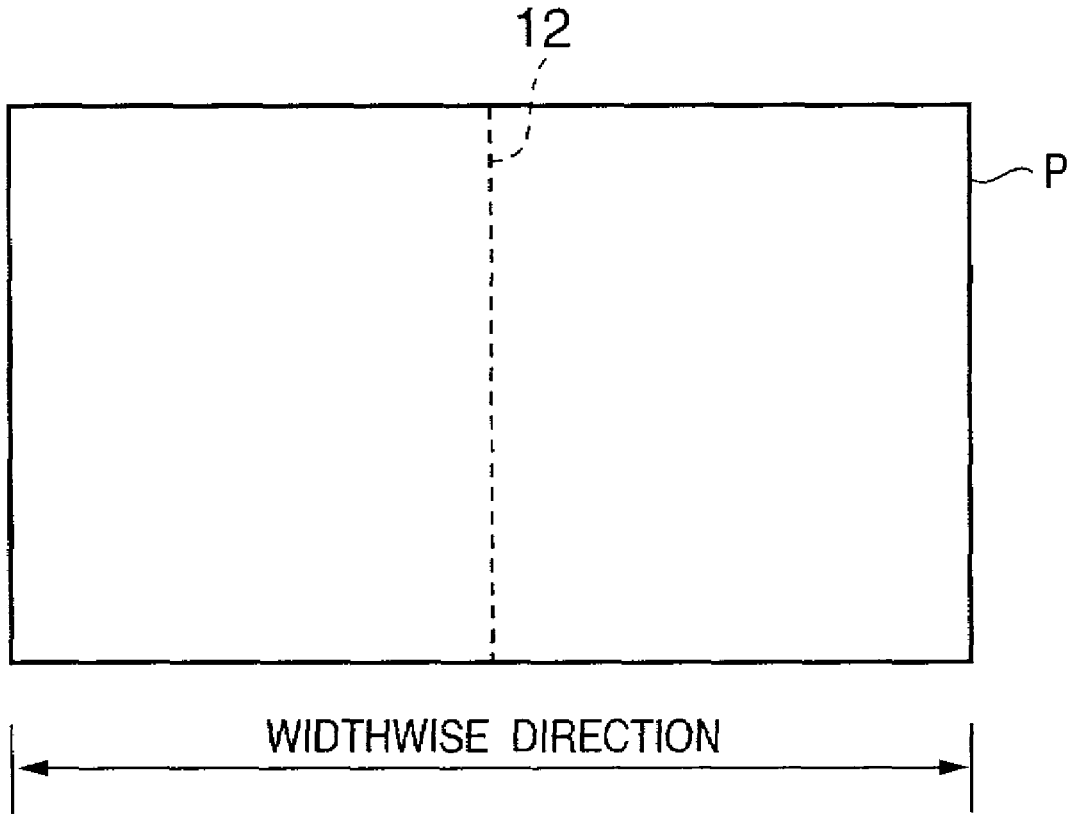
FIG. 3 is a view showing a perforated printing medium applied in the first embodiment according to the present invention.
Figure 4:
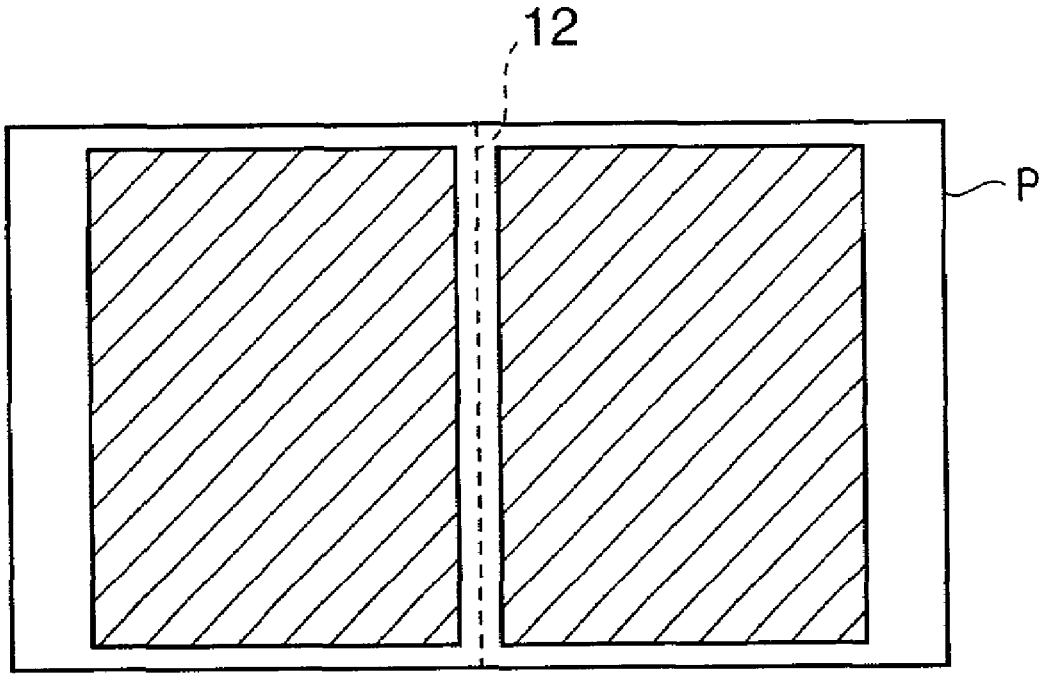
FIG. 4 is a view showing two printing regions set on one printing medium in the first embodiment according to the present invention.
Figure 5:
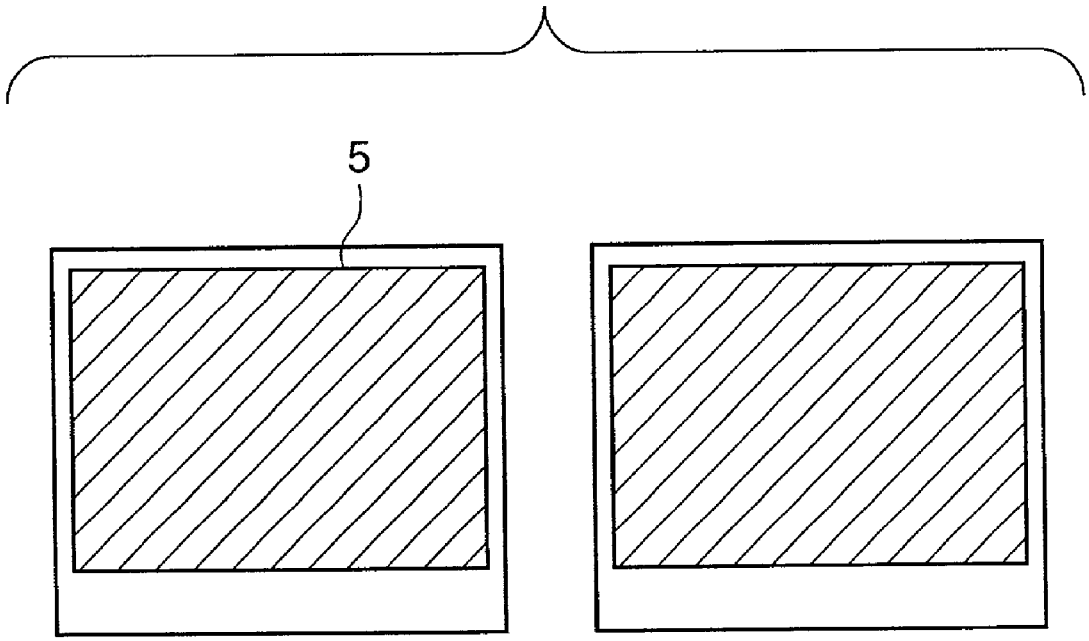
FIG. 5 is a view showing printed products when images are printed on the printing medium shown in FIG. 3 in the first embodiment according to the present invention.

FIG. 3 is a view showing a perforated printing medium (printing sheet) newly applied in the first embodiment according to the present invention. This printing sheet shown in FIG. 3 has the same size as the common printing sheet shown in FIG. 2, but the position of perforations 12 is different. That is, perforations equally dividing the printing sheet are formed in the center in the longitudinal direction. FIG. 4 is a view showing two printing regions set on one printing medium. FIG. 4 shows images printed on the printing sheet shown in FIG. 3. Hatched regions shown in FIG. 4 are regions (printing regions) where images are printed by the heat transfer printing apparatus. FIG. 5 shows printed products when images are printed on the printing medium shown in FIG. 3. That is, FIG. 5 shows examples of final printed products obtained by cutting the printed recording sheet shown in FIG. 4 from the central perforations. Referring to FIG. 5, images are printed in hatched regions 5.

<Description of Control Configuration>

A control configuration for executing the printing control of the apparatus will be described next.

Figure 12:
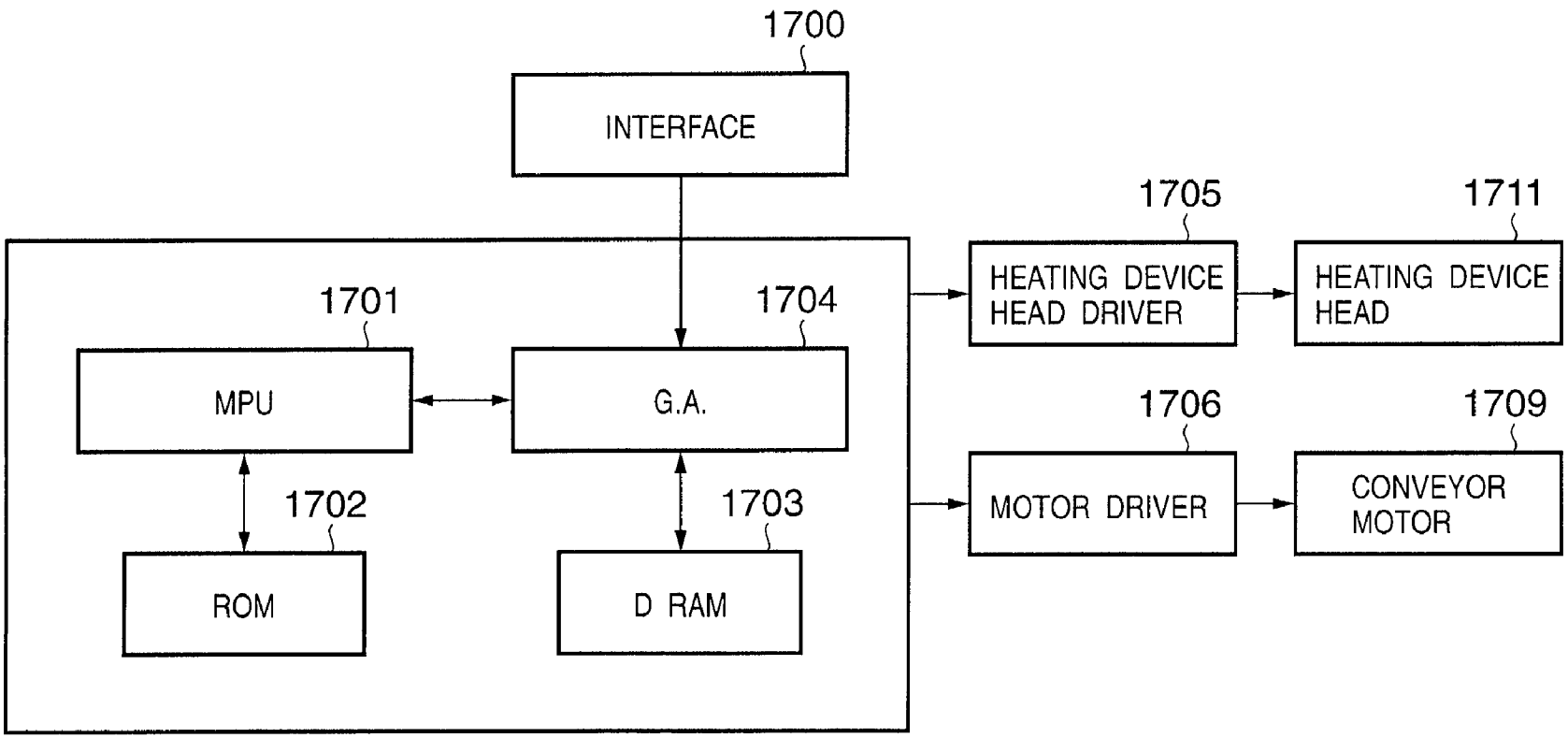
FIG. 12 is a diagram showing control blocks for executing printing control in the embodiments according to the present invention.
Figure 13:
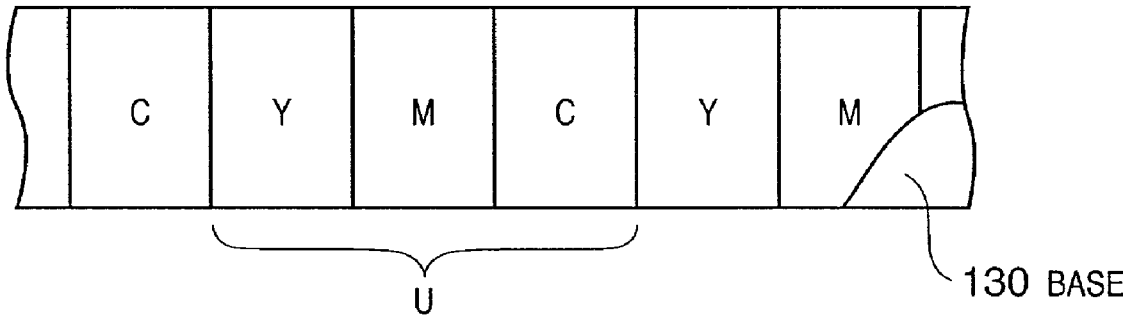
FIG. 13 is a view showing an example of an ink sheet.

FIG. 12 is a block diagram showing the configuration of a control circuit of this heat transfer printing apparatus. In FIG. 12 showing the control circuit, reference numeral 1700 denotes an interface for inputting a printing control signal; 1701, an MPU; 1702, a ROM for storing a control program to be executed by the MPU 1701; and 1703, a DRAM for saving various data (e.g., the printing control signal and heating control data to be supplied to a heating device head 1711). Reference numeral 1704 denotes a gate array (G.A.) for controlling the supply of the heating control data to the heating device head 1711. This gate array 1704 also controls data transfer between the interface 1700, the MPU 1701, and the RAM 1703. Reference numeral 1709 denotes a conveyor motor for conveying a printing sheet; 1705, a head driver for driving the heating device head; and 1706, a motor driver for driving the conveyor motor 1709.

The operation of the above control configuration will be explained below. The printing control signal input to the interface 1700 is converted into printing data between the gate array 1704 and the MPU 1701. The motor driver 1706 is driven, and the heating device head is also driven in accordance with the printing data supplied to the heating device head driver 1705, thereby printing the data.

In this embodiment, the ROM 1702 stores the control program to be executed by the MPU 1701. However, a programmable storage medium such as an EEPROM can be further added to change the control program from a host computer connected to the heat transfer printing apparatus.

Figure 6:
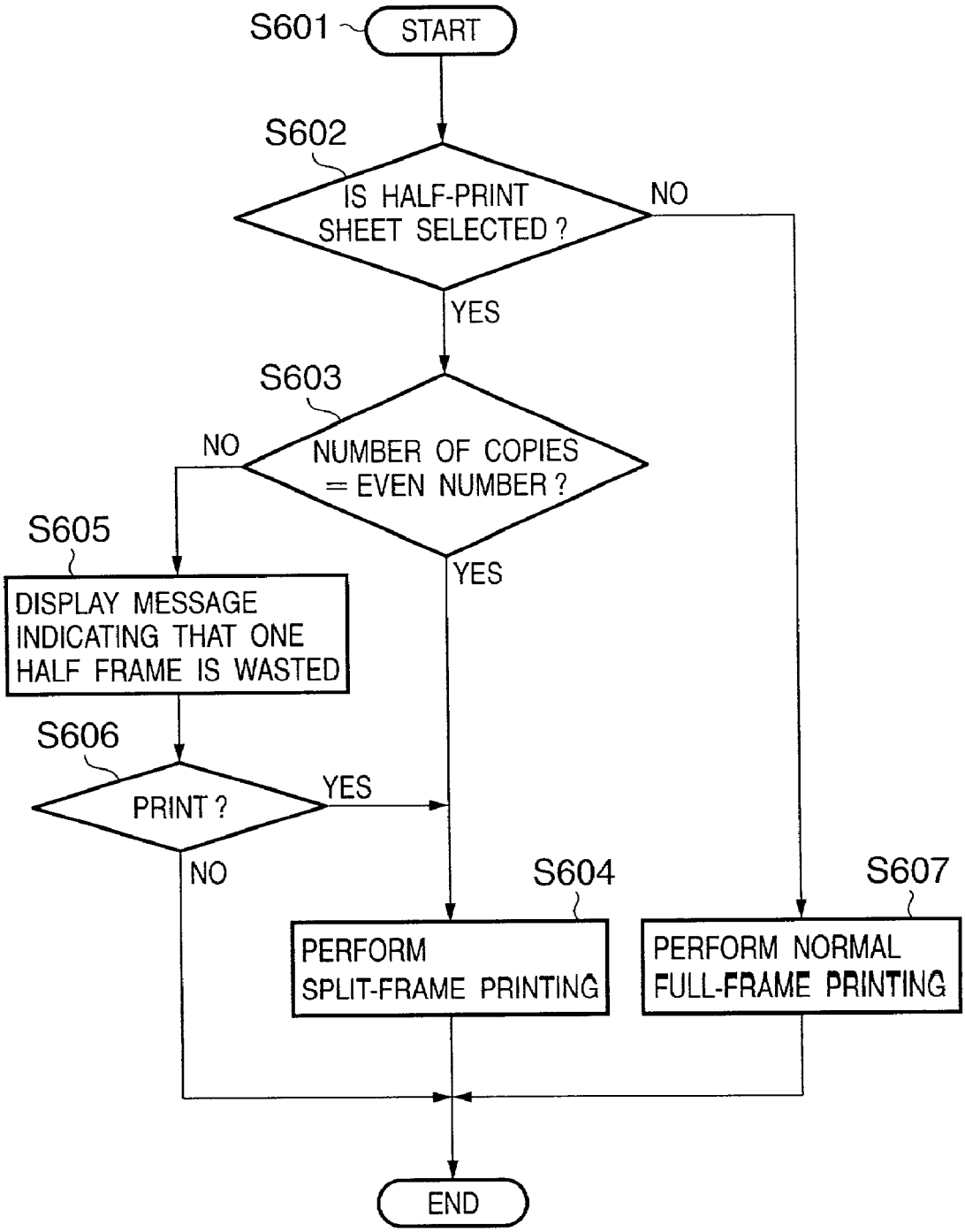
FIG. 6 is a flow chart showing the printing control sequence of the heat transfer printing apparatus used in the first embodiment according to the present invention.

FIG. 6 is a flow chart showing the whole of a printing control sequence executed when the heat transfer printing apparatus according to the embodiment of the present invention performs printing. To execute this sequence, the start of printing is designated and a printing sheet and the number of copies are set from the interface 1700, and printing is started. If a certain condition is set, the corresponding message is displayed, and the user gives an instruction of whether to continue or cancel the printing.

The heat transfer printing apparatus of this embodiment includes, as the user interface 1700, a plurality of buttons, a print button, an execute button, a preview button, a clear button, a menu button, cursor buttons in four directions, and the like. Also, the heat transfer printing apparatus of the present invention has an OSD (On Screen Display) for the purpose of user interface for setting printing conditions and the like. This makes it possible to select an image and set the number of copies and the like. The printing process according to this embodiment is performed by using this user interface function.

First, the user presses the print button to start printing. If the printing process is interrupted and the user wants to designate continuation of the printing, he or she presses the execute button to designate continuation of the printing. Also, the user presses the clear button to designate cancellation of the printing. The user sets a printing sheet and the number of copies in a sheet setting window and a number-of-copies setting window of the OSD. A message indicating that the half (one half frame) of a printing sheet is to be wasted by printing is displayed in a message window on the OSD.

This printing sequence is started when the user presses the print button of the heat transfer printing apparatus having the above user interface function (step S601 in FIG. 6).

When this sequence is started, whether a perforated half-print sheet shown in FIG. 3 or 4 is selected as a printing sheet is checked (step S602). If a half-print sheet is not selected as a printing sheet (NO in step S602), normal full frame printing is executed, and the sequence is completed.

If a half-print sheet is selected as a printing sheet (YES in step S602), this sequence advances the flow to step S603 to check whether the number of copies is an even or odd number. If the number of copies is an even number (YES in step S603), the sequence advances the flow to step S604 to execute split-frame printing as shown in FIGS. 4 and 5 (step S604), and the sequence is completed.

If the number of copies is not an even number (NO in step S603), the sequence advances the flow to step S605 to output a message indicating that one half frame is wasted if split-frame printing is performed with the current number of copies. The sequence waits for the user to designate continuation or cancellation of the printing (step S606). If designation indicating continuation of the printing is input (if the execute button is pressed) (YES in step S606), this sequence execute split-frame printing (step S604), and the sequence is completed.

If designation indicating cancellation of the printing is input (if the clear button is pressed) (NO in step S606), this sequence is completed without performing printing.

By the above processing, the heat transfer printing apparatus according to the present invention can readily obtain printed products having a plurality of different sizes as shown in FIGS. 2 and 5 by using printing sheets and ink sheets having the same size. That is, if a half-print sheet shown in FIG. 3 in which perforations are formed in the center in the widthwise direction of one printing sheet is selected, half printing can be performed for one printing sheet. Accordingly, half-sized printed products as shown in FIG. 5 can be obtained. On the other hand, if a normal printing sheet shown in FIG. 2 is selected, an image is printed on the entire surface of one printing sheet, so a printed product of a normal size can be obtained.

In the above embodiment, a user sets a printing sheet via the user interface. However, it is also possible to attach to each printing sheet an identification mark which corresponds to the format of the printing sheet, and install in the body of the heat transfer printing apparatus a unit for detecting this identification mark of each printing sheet, thereby setting a printing sheet by this detecting unit.

Second Embodiment

In the above embodiment, as shown in FIG. 3, perforations are formed in the center in the longitudinal direction of a printing sheet. A printing sheet is cut from these perforations to obtain printed products (half-sized printed products shown in FIG. 5) different in size from a printed product shown in FIG. 2. However, no printed product having an image printed on the entire surface can be obtained.

Figure 7:
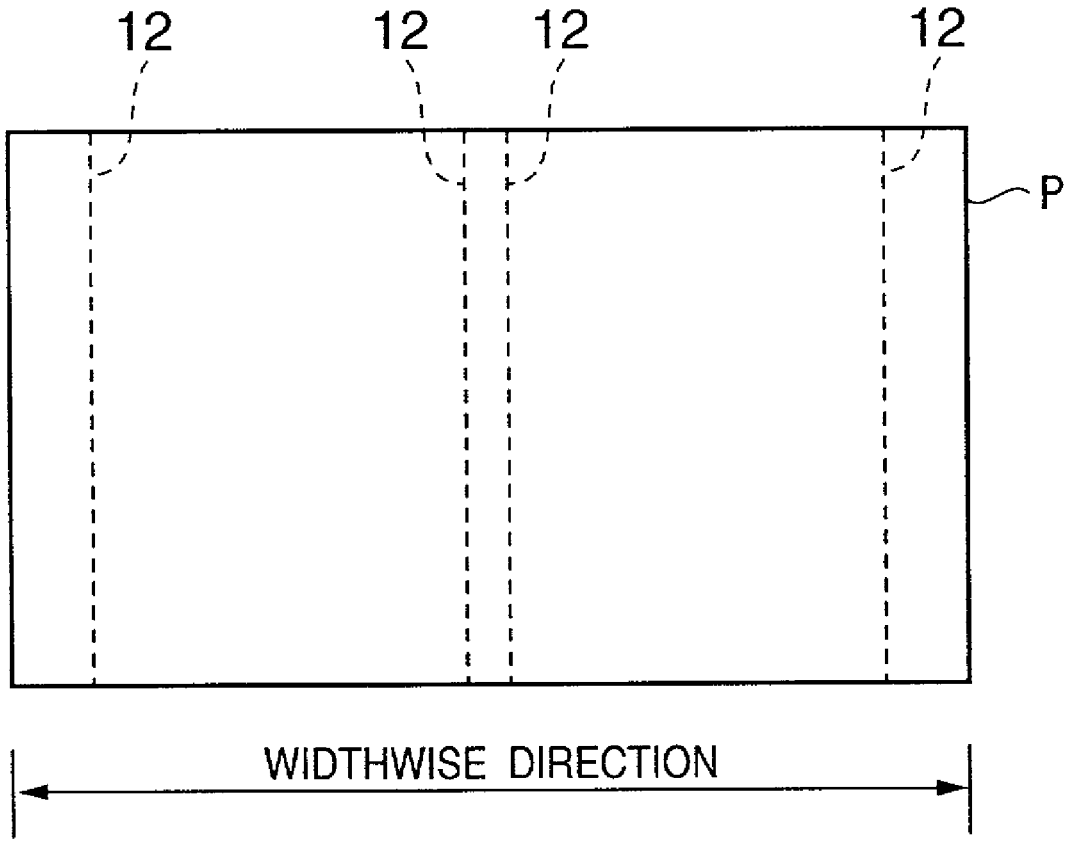
FIG. 7 is a view showing a perforated printing medium applied in the second embodiment according to the present invention.
Figure 8:
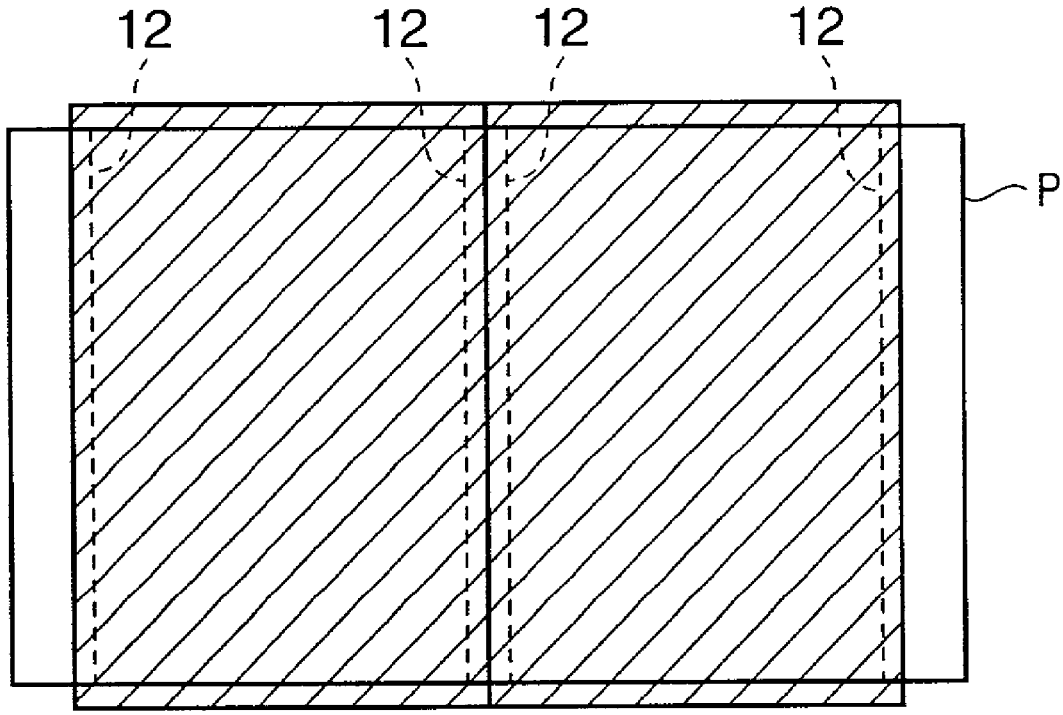
FIG. 8 is a view showing two printing regions set on one printing medium in the second embodiment according to the present invention.

FIG. 7 is a view showing a perforated printing medium applied in the second embodiment according to the present invention. This printing sheet shown in FIG. 7 is equal in size to, but different in perforation positions from, a normally used printing sheet shown in FIG. 2. That is, this printing sheet has four perforation lines in symmetrical positions with respect to the center in the longitudinal direction of the printing sheet. By using this printing sheet, a printed product (with no blanks) having an image printed on the entire surface can be obtained by changing the arrangement of image printing regions of the printing sheet. FIG. 8 is a view showing two printing regions set on one printing medium. Referring to FIG. 8, hatched regions are regions (printing regions) where images are printed by the heat transfer printing apparatus.

Figure 9:
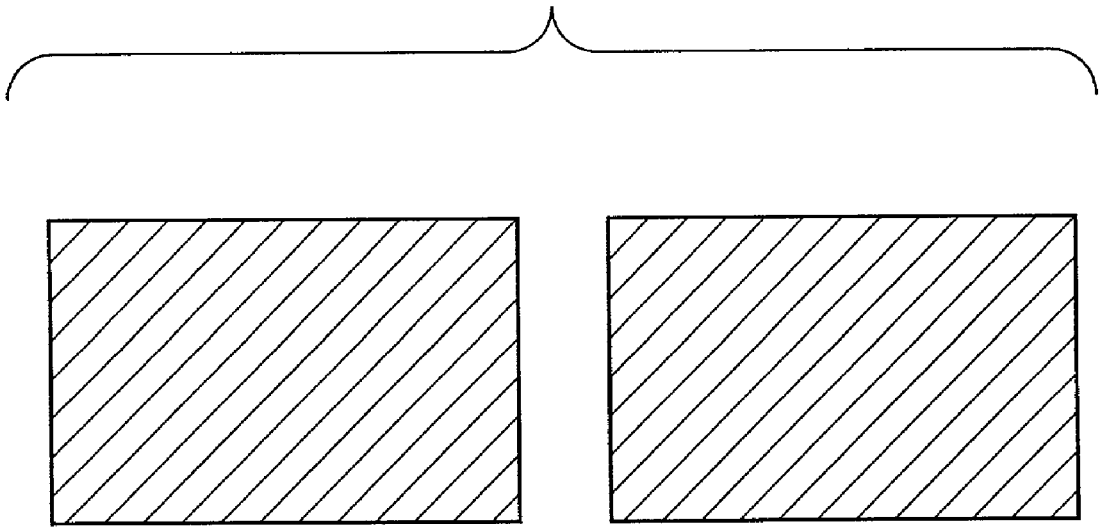
FIG. 9 is a view showing printed products when images are printed on the printing medium shown in FIG. 7 in the second embodiment according to the present invention.

FIG. 9 is a view showing printed products when images are printed on the printing medium shown in FIG. 7 in the second embodiment according to the present invention. That is, FIG. 9 shows examples of final printed products obtained by cutting the printing sheet shown in FIG. 8 from four perforation lines 12. Referring to FIG. 9, images are printed in hatched regions.

The process of this second embodiment will be described in detail below with reference to a flow chart.

Figure 10:
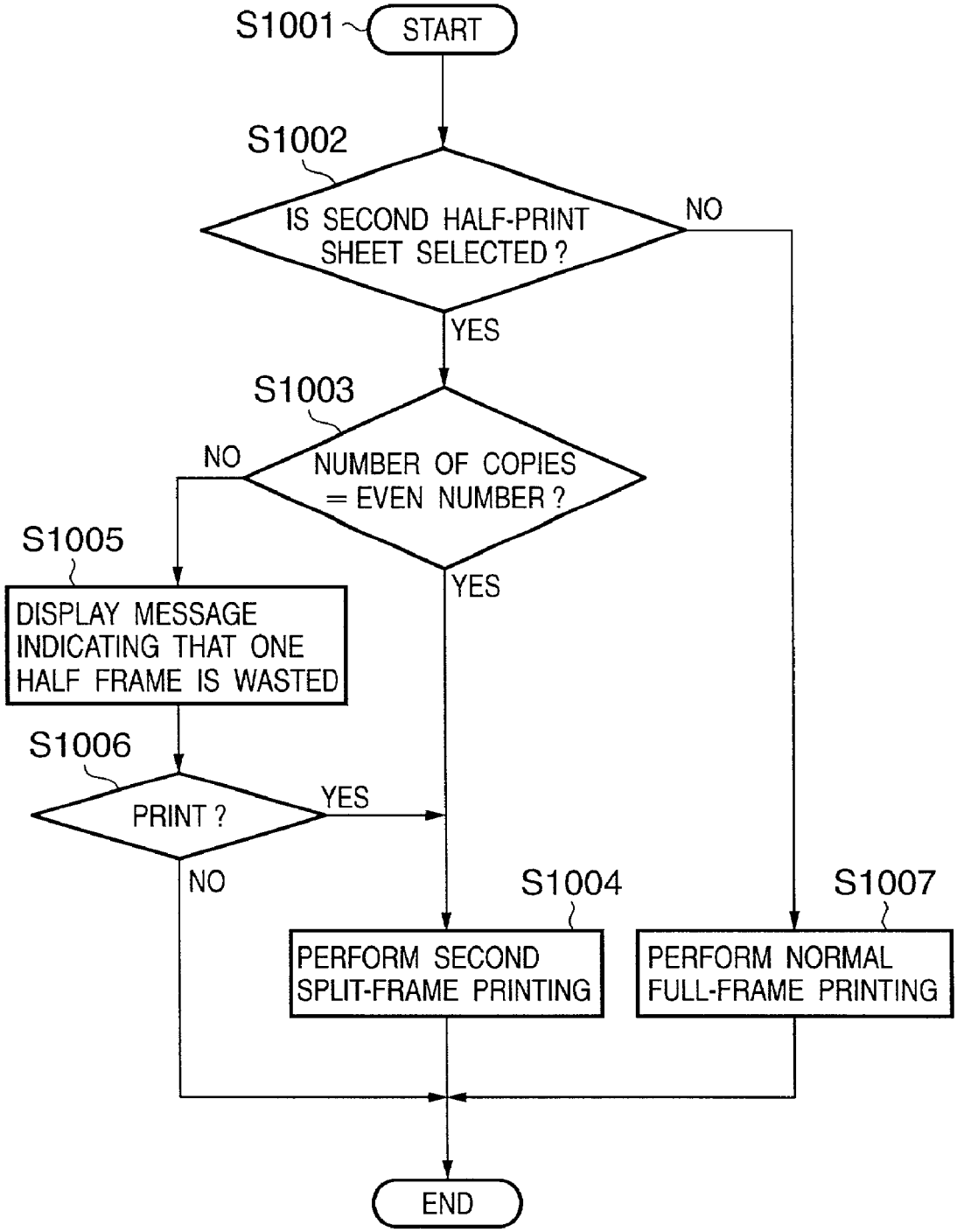
FIG. 10 is a flow chart showing the printing control sequence of the heat transfer printing apparatus used in the second embodiment according to the present invention.

FIG. 10 is a view showing the printing control sequence of the heat transfer printing apparatus used in the second embodiment according to the present invention. More specifically, FIG. 10 is a flow chart showing the whole printing sequence to be executed when the heat transfer printing apparatus controls printing as shown in FIG. 8.

One difference from the sequence (the flow chart shown in FIG. 6) of the first embodiment is the determination of setting of a printing sheet (second half-print sheet) (step S1002). Another difference is that image printing regions when split-frame printing is performed are, as indicated by the hatched portions in FIG. 8, longer than the length of the short side of the printing sheet as in the case of normal printing, unlike the ranges shown in FIG. 4 (second split-frame printing) (step S1004). That is, this "second split-frame printing" is a printing method of obtaining half-sized printed products having no blanks. In this method, printing is performed by setting the ranges outside the perforations as printing regions. If in step S1002 the use of a second half-print sheet as shown in FIG. 7 is set, the heat transfer printing apparatus performs control for changing the printing ranges. More specifically, although the ranges (hatched portions) of printing regions are set within the printing sheet P in FIG. 4, the ranges (hatched portions) of printing regions are set outside the printing sheet P along the short side of this printing sheet P in FIG. 8.

The sequence in FIG. 10 is the same as the sequence in FIG. 6 except the above two steps.

From the foregoing, the heat transfer printing apparatus according to this embodiment can readily form printed products having a plurality of different sizes shown in FIGS. 2 and 9 by using printing sheets and ink sheets having the same size.

In this embodiment, a user sets a printing sheet via the user interface. However, it is also possible to attach to each printing sheet an identification mark which corresponds to the format of the printing sheet, and install in the body of the heat transfer printing apparatus a unit for detecting this identification mark of each printing sheet, thereby setting a printing sheet by this detecting unit.

Third Embodiment

In the above description, the first and second embodiments are explained as separate embodiments. However, it is also possible to use a unit for individually setting the three types of printing sheets, i.e., the normal printing sheet (FIG. 2), the half-print sheet (the first embodiment, FIG. 3), and the second half-print sheet (the second embodiment, FIG. 7). When this is the case, printing can be performed by setting the ranges of printing regions suited to a printing sheet supplied from this setting unit to the heat transfer printing apparatus.

Figure 11:
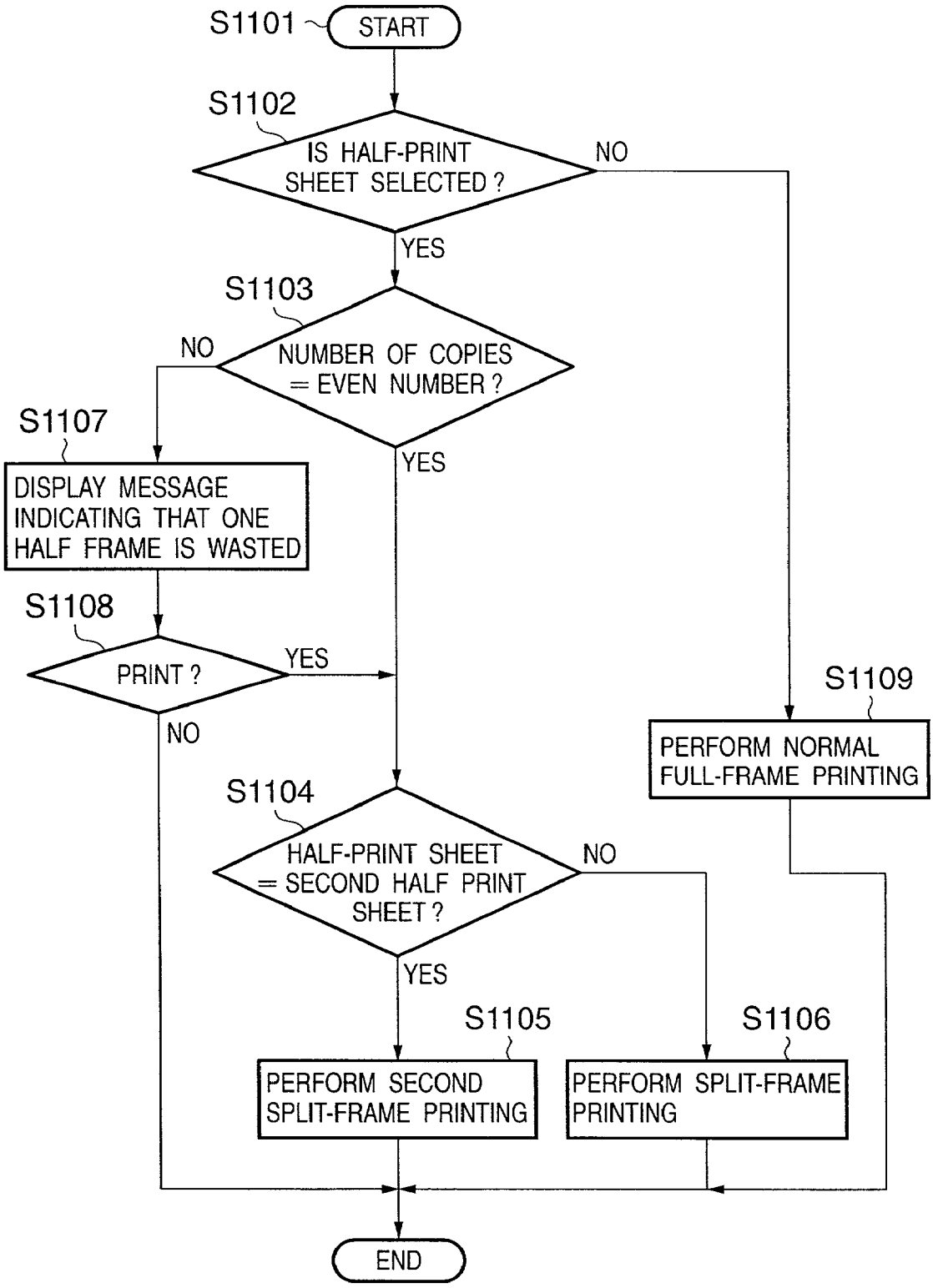
FIG. 11 is a flow chart showing the printing control sequence of a heat transfer printing apparatus used in still another embodiment according to the present invention.

The flow of processing in this case is shown in a flow chart of FIG. 11. That is, FIG. 11 is a view showing the printing control sequence of the heat transfer printing apparatus used in the third embodiment.

If no half printing is selected in step S1102 (NO in S1102), the flow advances to step S1109 to execute normal full-frame printing.

If half printing is selected (YES in S1102), in step S1104 the type of half-print sheet is checked. If the second half-print sheet (FIG. 7) is selected (YES in S1104), the flow advances to step S1105. If the second half-print sheet is not selected (NO in S1104), the flow advances to step S1106. In either case, the sequence is executed by setting printing ranges with respect to the selected printing medium.

In the above embodiment, the heat transfer printing apparatus can easily form printed products having a plurality of different sizes by using printing sheets and ink sheets having the same size.

Other Embodiments

In the above first to third embodiments, a half-print sheet by which one printing sheet can be split into two parts is used. However, in the present invention, the number of divided portions is not limited to two but can be any arbitrary number. For example, it is also possible to use a divide-by-4 printing sheet having perforations by which the sheet can be divided into four parts, or a divide-by-16 printing sheet having perforations by which the sheet can be divided into 16 parts. When this divide-by-4 or divide-by-16 printing sheet is used, printing ranges must be changed since they are different from the ranges of printing regions when a half-print sheet is used. That is, it is necessary to set the ranges of printing regions corresponding to 4 or 16 divided portions. In the present invention as described above, a divide-by-N (N is an integer of 2 or more) printing sheet can be used, and printed products having arbitrary sizes can be obtained by appropriately changing the ranges of printing regions in accordance with N.

The present invention can be applied to a system constituted by a plurality of devices (e.g., a host computer, interface, reader, and printer) or to an apparatus comprising a single device.

Further, the object of the present invention can also be achieved by supplying a storage medium (or a recording medium) recording program codes of software for implementing the functions of the above embodiments to a system or an apparatus, and reading out and executing the program codes stored in the storage medium by a computer (or a CPU or MPU) of the system or apparatus. In this case, the program codes read out from the storage medium implement the functions of the present invention, and the storage medium storing these program codes constitutes the invention. Also, besides the functions of the above embodiments are implemented by executing the readout program codes by the computer, the present invention includes a case where an OS (Operating System) or the like running on the computer performs part or the whole of actual processing in accordance with designations by the program codes and thereby implements the functions of the above embodiments.

Furthermore, the present invention also includes a case where, after the program codes read out from the storage medium are written in a memory of a function extension card inserted into the computer or of a function extension unit connected to the computer, a CPU or the like of the function extension card or function extension unit performs part or the whole of actual processing in accordance with designations by the program codes and thereby implements the functions of the above embodiments.

When the present invention is applied to the above-mentioned storage medium, this storage medium stores program codes corresponding to the flow charts (FIGS. 6, 10, and 11) explained above.

As has been explained above, the present invention can form printed products different in size from a printing medium having a fixed width, without preparing any printing media and ink sheets having a plurality of different sizes, and without wasting ink applied on an ink sheet.

As many apparently widely different embodiments of the present invention can be made without departing from the spirit and scope thereof, it is to be understood that the invention is not limited to the specific embodiments thereof except as defined in the appended claims.

What is claimed is:

1. A printing control apparatus for performing heat transfer printing on a printing medium by using a heat transfer sheet, comprising:

determining means for determining whether to perform printing by dividing a printing region in the widthwise direction of a printing medium having a fixed width; and printing control means for, when printing is to be performed by dividing the printing region in the widthwise direction of the printing medium in accordance with the determination by said determining means, controlling printing for consecutive pages by making printing information of the consecutive pages to correspond to the printing regions divided in the widthwise direction of the printing medium, wherein said printing control means counts the number of pages to be printed in accordance with the printing information and, if the counted number of pages is an odd number, notifies a user that one unit page becomes blank.

2. The apparatus according to claim 1, wherein the printing region in the widthwise direction of the printing medium is divided into not less than two printing regions.

3. A printing control apparatus for performing heat transfer printing on a printing medium by using a heat transfer sheet, comprising:

determining means for determining whether to perform printing by dividing a printing region in the widthwise direction of a printing medium having a fixed width;

printing control means for, when printing is to be performed by dividing the printing region in the widthwise direction of the printing medium in accordance with the determination by said determining means, controlling printing for consecutive pages by making printing information of the consecutive pages to correspond to the printing regions divided in the widthwise direction of the printing medium; and identifying means for identifying the type of printing sheet, wherein said printing control means controls printing in accordance with the identification by said identifying means.

4. A printing control method of performing heat transfer printing on a printing medium by using a heat transfer sheet, comprising:

the determination step of determining whether to perform printing by dividing a printing region in the widthwise direction of a printing medium having a fixed width; and the printing control step of, when printing is to be performed by dividing the printing region in the widthwise direction of the printing medium in accordance with the determination in the determination step, controlling printing for consecutive pages by making printing information of the consecutive pages to correspond to the printing regions divided in the widthwise direction of the printing medium, wherein the printing control step comprises counting the number of pages to be printed in accordance with the printing information and, if the counted number of pages is an odd number, notifying a user that one unit page becomes blank.

5. The method according to claim 4, wherein the printing region in the widthwise direction of the printing medium is divided into not less than two printing regions.

6. A printing control method of performing heat transfer printing on a printing medium by using a heat transfer sheet, comprising:

the determination step of determining whether to perform printing by dividing a printing region in the widthwise direction of a printing medium having a fixed width;

the printing control step of, when printing is to be performed by dividing the printing region in the widthwise direction of the printing medium in accordance with the determination in the determination step, controlling printing for consecutive pages by making printing information of the consecutive pages to correspond to the printing regions divided in the widthwise direction of the printing medium; and the identification step of identifying the type of printing sheet, wherein in the printing control step, printing is controlled in accordance with the identification in the identification step.

7. A heat transfer printing medium used in a heat transfer type printing control apparatus having a convey roller, comprising:

perforations in a position at which the dimension in a widthwise direction different from a convey direction of said printing medium is equally divided; and a blank portion clamped by the convey roller, when the said printing medium is conveyed by the convey roller.

wherein printing regions of said printing medium divided by said perforations are used as a unit page size, and wherein said perforations are used to separate a printing region of the unit page size, and wherein said blank portion is separated from said printing regions by said perforations.

8. The medium according to claim 7, wherein the position of the perforation is the center in the widthwise direction.

9. The medium according to claim 7, wherein said printing medium comprises four perforation lines in symmetrical positions with respect to the center in the widthwise direction of said printing medium.

* * * * *